United States Patent [19]

Vydrin et al.

[11] 4,213,320

[45] Jul. 22, 1980

[54] ROLL-FORGING MILL

[76] Inventors: Vladimir N. Vydrin, ulitsa Timiryazeva, 28, kv. 27; Evgeny N. Berezin, ulitsa Engelsa, 28, kv. 72; Vladimir G. Dremin, ulitsa Beloretskaya, 70, kv. 22, all of Chelyabinsk, U.S.S.R.

[21] Appl. No.: 956,619

[22] Filed: Nov. 1, 1978

[30] Foreign Application Priority Data

Nov. 1, 1977 [SU] U.S.S.R. ..... 2531851

[51] Int. Cl.[2] ..... B21B 13/18

[52] U.S. Cl. ..... 72/189; 72/406

[58] Field of Search ..... 72/189, 190, 406; 29/527.5, 527.7

[56] References Cited

U.S. PATENT DOCUMENTS

| | | | |
|---|---|---|---|
| 2,153,839 | 4/1939 | Liebergeld | 72/189 |
| 3,114,276 | 12/1963 | Uebing et al. | 72/406 |
| 3,474,652 | 10/1969 | Marcovitch | 72/190 |
| 3,583,192 | 6/1971 | Kocks | 72/189 |

*Primary Examiner*—Lowell A. Larson

*Attorney, Agent, or Firm*—Fleit & Jacobson

[57] ABSTRACT

A roll-forging mill comprises a roll stand with working tools adapted to perform oscillating movement by means of bars articulated on a support stand. The support stand is mounted for movement on stationary guides along the passline and is actuated by power cylinders operable to coordinate the traveling speed of the continuous metal strand with that of the roll stand at the moment of metal reduction, the actuator enabling the roll stand reciprocation being mounted on the support stand.

5 Claims, 7 Drawing Figures

ROLL-FORGING MILL

BACKGROUND OF THE INVENTION

This invention relates to rolling and more in particular to a roll-forging mill.

The invention is readily applicable for use in a combined continuous-casting and rolling plant where the casting and rolling operations are carried out in a single continuous technological process.

To ensure reliable and effective operation of such combined continuous-casting and rolling plant, it is necessary to eliminate axial stress in the strained metal. Axial stresses are due to occur in the metal being worked at a rolling mill as a result of interaction between the mill workrolls and the metal. The axial stress from the rolling mill is transmitted through the metal to the mould of a continuous casting machine, thereby causing idling periods in the operation of a continuous-casting and rolling plant.

To ensure effective combined operation of a continuous casting machine and a rolling mill, it is important to meet the following requirement: notwithstanding its small weight, the rolling mill should be capable of performing substantial amount of reduction in a single pass.

Therefore, the two aforementioned conditions are necessary for effective operation of a combined continuous-casting and rolling plant.

The first condition can be met by providing a single technological process wherein a continuous casting machine is used together with a conventional two-high mill incorporating grooved rolls, for example, such as described in Austrian Pat. No. 280,191. By varying the speed of rotation of the workrolls, the speed of casting is made equal to that of rolling, whereby axial stress is eliminated in the metal being worked. However, the amount of metal reduction in this case is small due to the overfilling of the roll pass.

An increase in the number of two-high mills (the installation of a continuous mill) with the purpose of enhancing the total amount of reduction will invariably lead to an increase in the mass of such rolling mills, which have been found inefficient due to the impossibility of eliminating axial stress in the strained metal. The difficulty here is to coordinate the speeds of rolling in the mill stands.

The problem of combining the continuous casting process with that of rolling is possible to solve by making use of a roll-forging mill, which is capable, at its small weight, of performing rolling of the continuous-cast ingot with a substantial amount of reduction per pass.

The roll-forging mill mentioned above comprises a power driven roll stand mounted on a frame for reciprocation along the passline and provided with working tools, such a strikers, which perform rocking motion through the intermediary of bars articulated on a support stand. The support stand and the roll stand actuator are rigidly secured on the frame.

As the roll stand advances, the strikers perform pendulum-like motion under the action of the bars, thereby effecting reduction of metal along the rolling cone. Reduction of metal is effected in a single pass during forward movement of the roll stand, whereupon a successive portion of metal is fed for rolling by means of a feeding and clamping mechanism during the return idle movement of the roll stand. The feeding mechanism is positioned at the side of the metal entry into the roll stand and the clamping mechanism at the exit therefrom.

In the course of operation of the above-described mill, axial stresses are due to occur in the metal being worked because of fixed positions of the support stand and of the roll stand actuator.

In the process of rolling effected at such mill the metal remains immobile at a moment of reduction, whereas the billet produced at a continuous-casting machine remains in continuous motion. Therefore, axial stresses in the metal under strain are unavoidable in the combined continuous-casting and rolling processes. Needless to say that the presence of axial stresses in the metal being worked is too serious a flaw to be disregarded.

What is required is a roll-forging mill of the type permitting the elimination of axial stresses due to occur in the strained metal during its reduction. Working tools in such mill are permitted to operate in synchronism and the mill per se is made more simple in construction and easy in operation.

SUMMARY OF THE INVENTION

The invention provides a roll-forging mill comprising a power-driven roll stand mounted for reciprocation along the passline and provided with working tools performing pendulum-like motion transmitted thereto through bars articulated on a support stand, wherein, according to the invention, the mill support stand is mounted on stationary guides for movement along the passline and is actuated by means of power cylinders secured to a frame and operable to coordinate the traveling speed of the metal being worked with that of the roll stand at a time of the metal reduction, with the roll stand actuator being mounted on the said support stand.

Such structural arrangement makes it possible to eliminate axial stress due to occur in the metal being worked. This is attained by that the support stand carrying the roll stand actuator rigidly secured thereto is mounted for movement and is connected with power cylinders fixedly attached to a stationary cross-bar. By building up pressure in the power cylinders to a given value, the "roll stand—support stand—actuator" system can be rendered movable during metal reduction at a speed equal to the travelling speed of metal at which it emerges from the mould of a continuous casting machine (the "roll stand—support stand—actuator" system is in the state of "floating" relative to the stationary frame of the mill). In this way the traveling speed of the metal being worked is coordinated with that of the "roll stand—support stand—actuator" system, whereby the axial stress in the strained metal is eliminated.

In one embodiment of the invention, the guides are made in the form of columns positioned in parallel to the passline and fixed in the stationary cross-bars of which one is arranged before the roll stand, if viewed in the direction of rolling, and the other one behind the support stand.

With the guides being formed as columns disposed in parallel to the passline, an accurate centering of the roll stand relative to the support stand is permitted to thereby result in synchronous operation of the working tools.

In addition, each cross-bar incorporated in the rolling mill of the invention has its central portion formed with an opening adapted to accommodate guides for the passage of the metal being worked.

The provision of such guide-receiving openings makes it possible to provide the guide fittings of simple construction, thus making use of readily available fixing means and avoiding the necessity of providing special guide-fixing means.

To render the mill more simple in construction, the power cylinders actuating the support stand are mounted to a crossbar disposed behind the support stand, with the rods of said cylinders being connected with the latter. No special means are required for fixing the cylinders.

BRIEF DESCRIPTION OF THE DRAWINGS

The invention will be further described, by way of example only, with reference to the accompanying drawings, wherein.

DETAILED DESCRIPTION OF THE PREFERRED EMBODIMENTS

Figure 1:
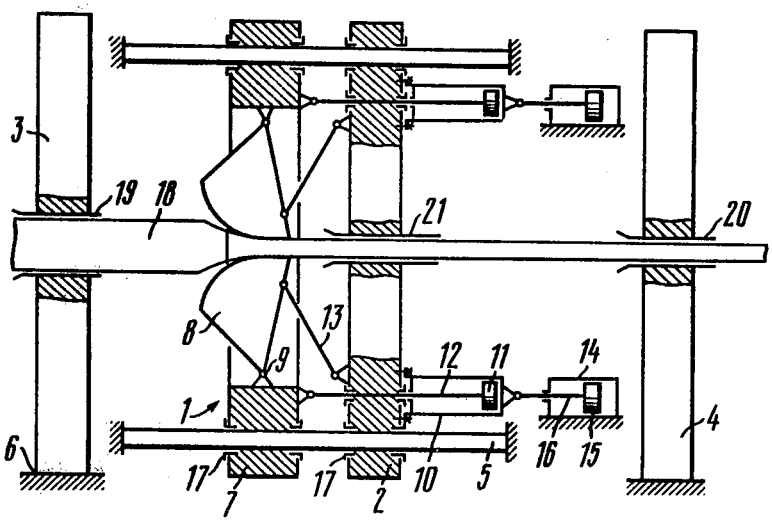
FIG. 1 is a plan view of one embodiment of a roll-forging mill according to the invention.

Referring now to the drawings, and to FIG. I in particular, there is shown therein a roll-forging mill which comprises a roll stand I, a support stand 2, cross-bars 3 and 4, of which the cross-bar 3 is positioned before the roll stand I, if viewed in the direction of rolling, and the cross-bar 4 behind the support stand 2. The roll stand 1 and the support stand 2 are mounted on common stationary guides 5. All the basic structural elements of the rolling mill are located on a common frame 6.

The roll stand I comprises a one-piece support structure 7 in which are fixed working tools 8 pivoted at 9. Rolls or specially shaped strikers can be used as the working tools.

The roll stand 1 is mounted for reciprocation along the pass-line and can be driven by any conventional actuator. In the preferred embodiment the roll stand actuators are basically hydraulic cylinders 10 secured to the support stand 2 and provided with pistons II have their rods 12 connected with the roll housing 7.

During the roll stand reciprocation, the working tools perform rocking motion transmitted thereto through bars 13 with one end thereof being pivotally connected to the tools, and the other one being also pivotally connected to the support stand 2.

The support stand 2 is mounted for movement along the passline on the stationary guides 5 also used for the roll stand 1 to move thereof. The support stand 2 with the roll stand actuator secured thereto is moved by means of an actuator made in the form of power cylinders fixed on the frame 6, in the given case hydraulic cylinders 14 are used, with pistons 15 having their rods 16 connected to the support stand 2. In the given case the connection is effected through the body of the roll stand actuator.

The roll stand I and the support stand 2 rest upon the guides through sleeves 17.

To permit the passage of the metal 18 to be worked, the mill, cross-bars 3 and 4, as well as the support stand 2 are formed with openings adapted to accommodate guides 19, 20 and 21, respectively.

Figure 2:
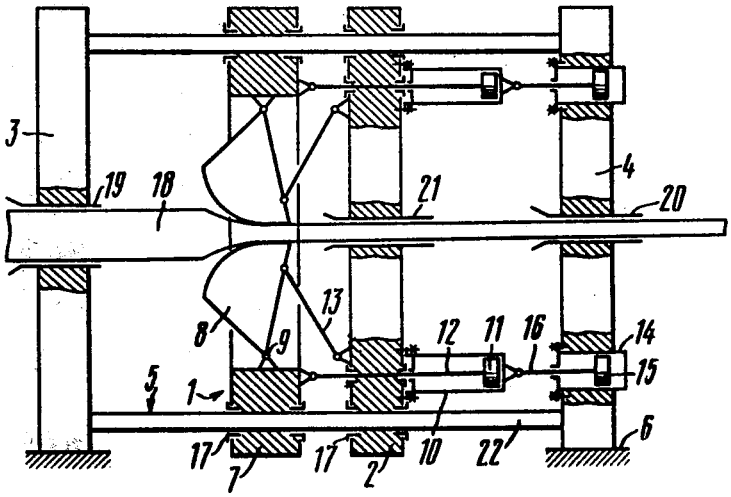
FIG. 2 is a longitudinal sectional view of another embodiment of the invention.
Figure 3:
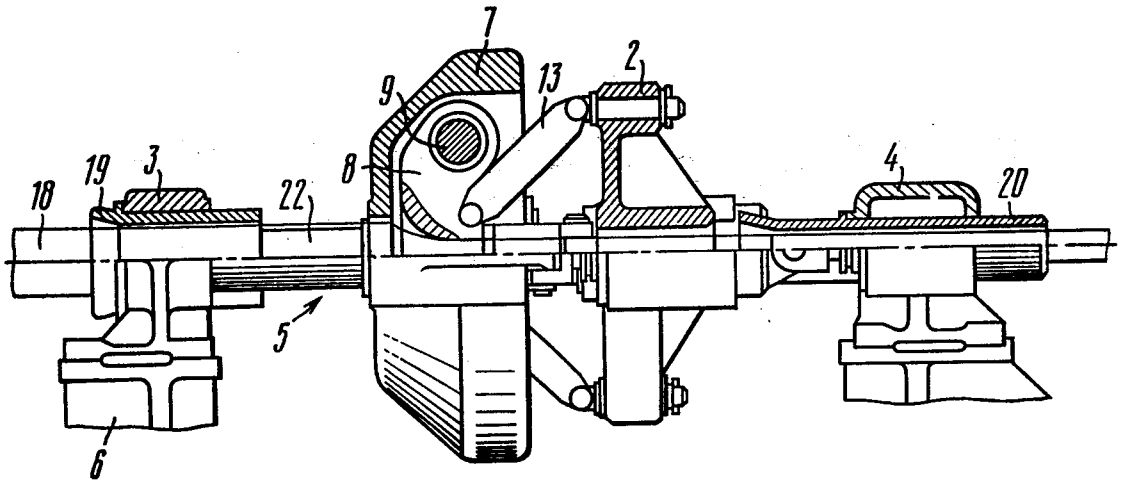
FIG. 3 is a side elevation view of same.
Figure 4:
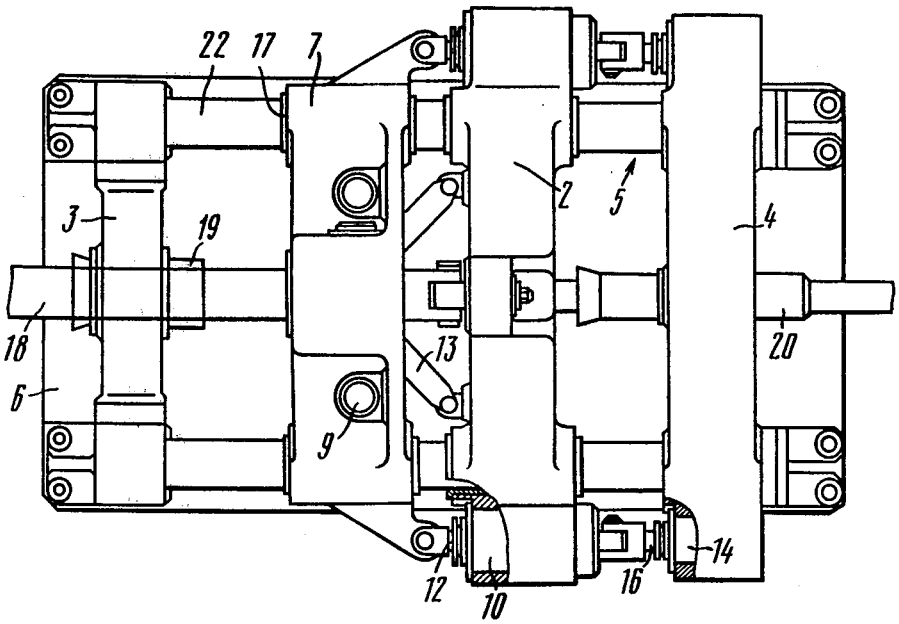
FIG. 4 is a plan view of same.

The roll-forging mill of the invention can be variously otherwise embodied such as shown in FIGS. 2,3 and 4. The distinctive feature of this embodiment lies in that the guides 5 are made in the form of columns 22 which are positioned in parallel to the passline and are secured to the stationary cross-bars 3 and 4, which eliminates the necessity in special means for fixing these guides to the mill frame 6.

Another distinctive feature of the above-mentioned embodiment resides in that the power cylinders are fixed in the cross-bar 4, thus rendering the mill more simple in construction.

Figure 5:
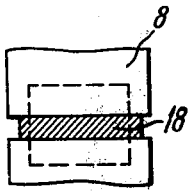
FIGS. 5–7 show possible variations of the billet profiles.
Figure 6:
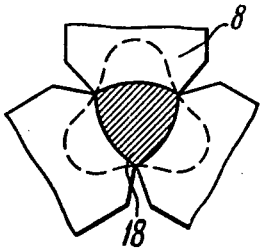
Figure 7:
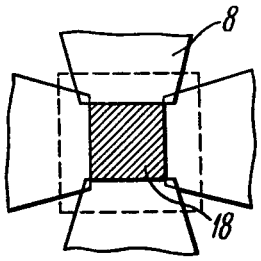

The mill according to the invention permits the production of variously shaped billets. Shown in FIG. 5 is the production of a sheet slab, performed by way of reducing metal with the aid of two working tools. FIG. 6 shows the production of a complex triangle section by reducing the metal with the aid of three working tools arranged round its cross-sectional periphery. FIG. 7 shows the production of a square-shaped billet, effected by means of two sets of working tools of which one pair is adapted to perform metal reduction in the horizontal, and the other one in the vertical.

The roll-forging mill of the invention operates in the following manner.

The metal 18 to be worked emerges from the mould of a continuous casting machine and then passes at the same casting speed through the inlet guide 19 to the working tools 8 of the roll stand I. Under the action of the power cylinders 10 in assembly with the pistons II and rods 12, the roll stand 1 performs reciprocated motion relative to the support stand 2 and to the metal being worked the working tools 8 also performing rocking motion under the action of the bars 13. As pressure is mounted in the rod chamber of the hydraulic cylinders 10, the roll stand 1 is moved in the direction of rolling to thereby effect reduction of the metal by means of the working tools 8. With the pressure in the power cylinder 10 being brought down, the roll stand is returned to its original position without effecting rolling operation.

The roll stand I, connected with the support stand 2 through the bars 13, as well as the rods 12 of the cylinders 10 secured to the support stand 2, form the closed "roll stand —actuator—support stand" power system. The forces which come into being within this system are not transmitted to other elements of the mill.

When the metal 18 is gripped by the working tools 8, the power system is caused to move at a speed equal to the traveling speed of the metal being worked at the entrance to the mill (the metal casting speed). Such movement is made possible under the action of the force applied to the system from the power cylinders 14 through the rods 16, which is equal in value to the forces counteracting the movement of the system (primarily, to friction forces). With this purpose pressure is mounted in the rod chamber of the power cylinders 14, whereby the "roll stand—actuator—support stand" system is displaced in the direction of rolling at a speed equal to the speed of casting. As the strikers are brought out of contact with the metal being worked, pressure in the power cylinders 14 is reversed, i.e., the working fluid is supplied to the piston chambers of the power cylinders 14 instead of the rod chambers and the "roll stand—support stand—actuator" system is returned to its original position.

The mill gearing system permits the movement of the "roll stand—support stand—actuator" system to be effected at an equal speed with the traveling speed of the metal being worked, thereby eliminating axial stress in the strained metal subject to reduction. From the above it follows that one of the most important conditions required for effective operation of a combined continuous-casting-and-rolling plant is fulfilled.

We claim:

1. A roll-forging mill for working metal along a passline comprising: a frame; a roll stand mounted on said frame for reciprocation along a passline; an actuator for controlling movement of said roll stand; working tools mounted on said roll stand for rocking motion to thereby perform reduction of a metal being worked; stationary guides disposed in parallel to the passline; a support stand mounted on said guides for movement along the passline; a plurality of bars, each bar having one end pivotally connected to said support stand and the other end eccentrically pivoted to one of said working tools for imparting rocking motion to said working tools; power cylinder means secured on said frame and connected with said support stand for coordinating the travelling speed of the roll stand with the speed of the metal being worked during reduction; said roll stand actuator being mounted on said support stand and connected with the roll stand for reciprocating said roll stand thereby transmitting rocking motion to said working tools.

2. A mill as claimed in claim 1, wherein said guides are made in the form of columns disposed in parallel to the passline and fixed in a pair of stationary cross-bars of which one is positioned before the roll stand, when viewed in the direction of working of the metal, and the other one behind the support stand.

3. A mill as claimed in claim 2, wherein each cross-bar has a central portion formed with an opening adapted to receive guides for the passage of the metal to be worked.

4. A mill as claimed in claim 2, wherein the power cylinder means includes a cylinder mounted on the cross-bar positioned behind the support stand, said cylinder having a rod connected with said support stand.

5. A mill as claimed in claim 3, wherein the power cylinder means includes a cylinder mounted on the cross-bar positioned behind the support stand, said cylinder having a rod connected with said support stand.

* * * * *